US005746335A

United States Patent [19]

Brough et al.

[11] Patent Number: 5,746,335

[45] Date of Patent: May 5, 1998

[54] DOUBLE ACTING CENTER-OF-CAR CUSHIONING DEVICE

[75] Inventors: Steve A. Brough, Gardners; John F. Deppen, New Cumberland, both of Pa.

[73] Assignee: Keystone Industries, Inc., Camp Hill, Pa.

[21] Appl. No.: 637,045

[22] Filed: May 1, 1996

[51] Int. Cl.[6] ..... B61G 7/00

[52] U.S. Cl. ..... 213/43; 188/312; 213/45

[58] Field of Search ..... 213/8, 43, 45, 213/44, 223, 73; 188/287, 312, 313, 315

[56] References Cited

U.S. PATENT DOCUMENTS

| | | | |
|---|---|---|---|
| 875,021 | 12/1907 | Westbrook . | |
| 1,064,214 | 6/1913 | Herman . | |
| 1,094,994 | 4/1914 | Hufford . | |
| 1,151,068 | 8/1915 | Van Auken . | |
| 1,273,059 | 7/1918 | Hild | 188/312 |
| 1,494,135 | 5/1924 | Robison et al. | 188/287 |
| 2,029,829 | 2/1936 | Messier | 188/312 |
| 2,557,274 | 6/1951 | Geisse | 244/103 |
| 2,752,048 | 6/1956 | Fillion | 213/8 |
| 2,811,264 | 10/1957 | Gray | 213/45 |
| 2,814,364 | 11/1957 | Lowe | 188/148 |
| 2,915,198 | 12/1959 | Spenceer | 213/43 |
| 2,917,303 | 12/1959 | Vierling | 267/8 |
| 2,965,246 | 12/1960 | Guins | 213/8 |
| 2,973,102 | 2/1961 | Nystorm | 213/8 |
| 2,992,815 | 7/1961 | Ellis, Jr. | 267/8 |
| 3,006,483 | 10/1961 | Baillie et al. | 213/8 |
| 3,163,300 | 12/1964 | Settles | 213/8 |
| 3,186,562 | 6/1965 | Angold | 213/8 |
| 3,215,229 | 11/1965 | Bunnell | 188/312 |
| 3,221,898 | 12/1965 | Pellnitz | 213/8 |
| 3,237,574 | 3/1966 | Smith et al. | 105/454 |
| 3,307,883 | 3/1967 | Wustenhagen et al. | 308/3.5 |
| 3,344,894 | 10/1967 | Kenworthy | 188/96 |
| 3,361,269 | 1/1968 | Peterson | 213/8 |
| 3,368,697 | 2/1968 | Carlson | 213/40 |
| 3,369,674 | 2/1968 | Carle | 213/43 |
| 3,379,319 | 4/1968 | Stasieluk | 213/22 |
| 3,731,914 | 5/1973 | Cope et al. | 267/65 R |
| 3,749,255 | 7/1973 | Cope | 213/8 |
| 3,776,391 | 12/1973 | Hawthorne | 213/8 |
| 3,843,107 | 10/1974 | Atkins | 188/287 |
| 3,851,768 | 12/1974 | Hawthorne | 213/43 |
| 3,913,748 | 10/1975 | Carle | 213/8 |
| 4,026,418 | 5/1977 | Hawthorne | 213/8 |
| 4,154,461 | 5/1979 | Schnittger | 280/710 |
| 4,304,338 | 12/1981 | Carle et al. | 213/8 |
| 4,413,817 | 11/1983 | Bich | 267/64.11 |

(List continued on next page.)

FOREIGN PATENT DOCUMENTS

| | | |
|---|---|---|
| 2907101 | 4/1980 | Germany . |
| 841410 | 7/1960 | United Kingdom . |

OTHER PUBLICATIONS

Keystone Railway Equipment Co., "Keystone Shock Control," 1966, pp. 1–8.

Keystone Railway Equipment Co., "Keystone Shock Control Hydraulic Cushioned Underframe"(no date).

Keystone Railway Equipment Company, "Keystone G & GR Series End–of–Car Cushion Units"(no date).

Keystone Railway Equipment Company, Keystone SA–Soms Single Acting Center–of–Car Cushion Unit, Jan. 1990.

Keystone Railway Equipment Company, "Model SA and SA–MS Inspection and Maintenance" (no date).

*Primary Examiner*—Mark T. Le

*Attorney, Agent, or Firm*—Thomas Hooker, P.C.

[57] ABSTRACT

A double acting center-of-car cushioning device mounted in the sliding sill of a rail car includes two pistons and rods, two pressure cylinders and mirror image sets of flow orifices in the pressure cylinders. The piston rods extend out from ends of the pressure cylinders and engage a fixed sill of the rail car. Movement of the pistons within the pressure cylinders forces fluid through the flow orifices resulting in efficient dampening.

14 Claims, 2 Drawing Sheets

U.S. PATENT DOCUMENTS

| | | | |
|---|---|---|---|
| 4,557,696 | 12/1985 | Nakahama | 440/61 |
| 4,739,889 | 4/1988 | Bomgardner | 213/43 |
| 4,741,085 | 5/1988 | Bomgardner | 293/402.08 |
| 4,756,512 | 7/1988 | Toms, Jr. | 267/70 |
| 5,323,884 | 6/1994 | Machino | 188/312 |
| 5,361,706 | 11/1994 | Kunczynski | 188/312 |
| 5,388,711 | 2/1995 | Hodges | 213/8 |
| 5,415,303 | 5/1995 | Hodges et al. | 213/43 |

DOUBLE ACTING CENTER-OF-CAR CUSHIONING DEVICE

FIELD OF THE INVENTION

The invention relates to underframe rail car cushioning devices of the type mounted on a sliding sill and connected to a fixed sill. Coupling devices are mounted on the ends of the sliding sill. The cushioning devices are double acting and dampen buff and draft loads exerted on the couplers to protect lading on rail cars.

DESCRIPTION OF THE PRIOR ART

U.S. Pat. No. 5,388,711 discloses a center-of-car cushioning device mounted on a rail car sliding sill and connected to a fixed sill. The device is double acting and includes a single pressure cylinder and an outer cylinder, both which extend between a pair of end heads. A piston is mounted in each end of the pressure cylinder and is connected to a piston rod which extends outwardly through a bore in the adjacent end head. A single set of flow orifices is spaced along the interior wall of the pressure cylinder. Flow control valves are mounted in some of the orifices. The device is charged with hydraulic fluid and pressurized gas so that the movement of one of the pistons along the pressure cylinder and past the orifices flows hydraulic fluid out of the cylinder and dampens buff and draft loadings exerted on the sliding sill.

In the cushioning device disclosed in U.S. Pat. No. 5,388,711 each piston moves past a single set of flow control orifices in the cylinder. The size and location of these orifices control the outward flow of hydraulic fluid from the pressure cylinder. Use of one same set of orifices to dampen movement of two pistons moving in opposite directions reduces damping efficiency, despite the use of delay valves in some of the orifices.

Efficient damping using hydraulic cushioning devices the type disclosed in U.S. Pat. No. 5,388,711 requires that the area of the active orifices located ahead of the piston be reduced as the piston travels along the cylinder. This reduction in the area of the active orifices tends to keep the force level constant during the stroke and absorbs a maximum amount of energy. This condition cannot be met for each piston in the cushioning device disclosed in U.S. Pat. No. 5,388,711 because the pistons traverse the same set of orifices, but in opposite directions.

SUMMARY OF THE INVENTION

The invention is an improved double acting center-of-car cushioning device which is mounted in the sliding sill of a rail car and connected to the fixed sill in order to dampen buff and draft loadings. Piston rods extend out from each end of a cylindrical pressure housing which is mounted in a conventional pocket in the sliding sill. The ends of these rods engage stops mounted on the sill.

Each piston rod is connected to a piston mounted in one end of the housing with each piston moveable during collapse along a separate pressure cylinder in the housing and past a set of flow orifices formed through the wall of the cylinder. The two sets of orifices are sized and located along the two cylinders to optimize cushioning. The provision of a single set of properly sized and located orifices in each cylinder which is traversed by a single piston assures efficient consumption of energy and efficient dampening.

Other objects and features of the invention will become apparent as the description proceeds, especially when taken in conjunction with the accompanying drawings illustrating the invention, of which there are two sheets and one embodiment.

DESCRIPTION OF THE PREFERRED EMBODIMENT

Figure 1:
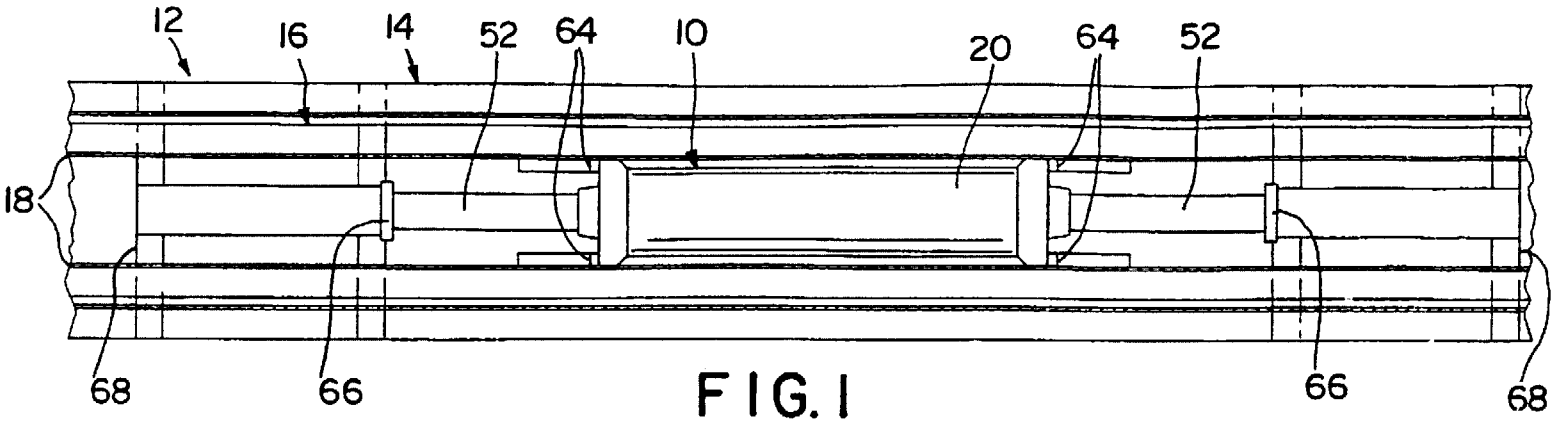
FIG. 1 is a horizontal sectional view taken through the sill of a rail car illustrating the invention.

Double acting center-of-car cushioning device 10 is mounted in the underframe 12 of a rail car (not illustrated) as shown in FIG. 1. The underframe includes an elongate fixed sill 14 having a pair of opposed walls and a central elongate sliding sill 16 mounted in the fixed sill and longitudinally movable along the fixed sill. The sliding sill is slightly longer than the fixed sill and includes ends which extend beyond the end of the rail car. Coupling equipment is attached to the ends of the sliding sill to facilitate coupling of the rail car to adjacent rail cars in a train. The sliding sill is U-shaped in cross-section with a pair of spaced vertical walls 18, shown in FIG. 1, positioned between the walls of the fixed sill.

Cushioning device 10 includes a generally cylindrical housing 20 made up of an outer cylindrical body 22 and a pair of end heads 24 which are welded onto the ends of body 22. A pair of like pressure cylinders 26 and 28 having a diameter less than the diameter of body 22 are fitted in body 22 on bosses on the inner surfaces of the heads and extend to a center plate 30 located equidistant from the heads. Cylinders 26 and 28 are joined to the heads and plate.

Figure 5:
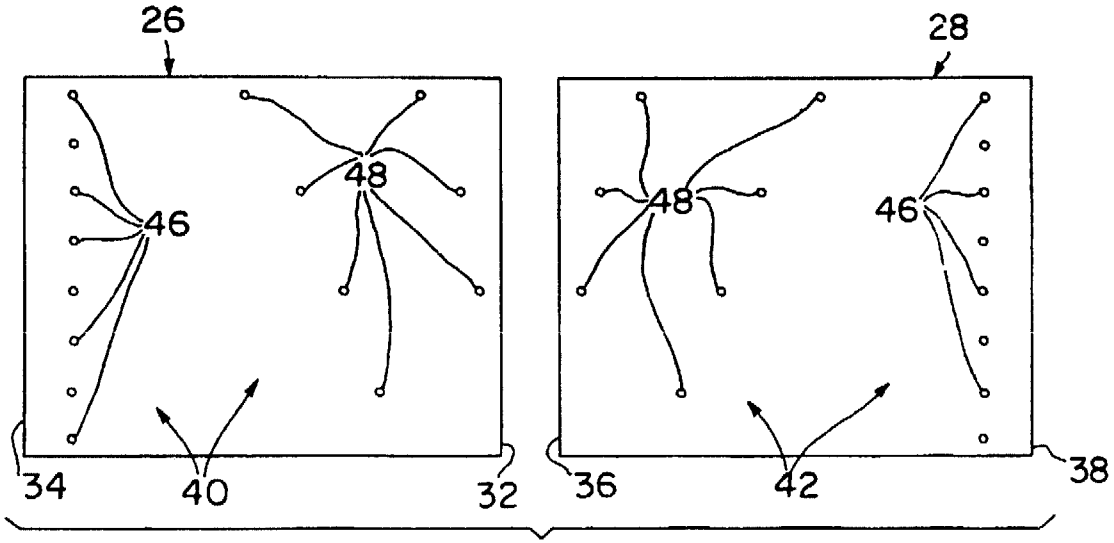
FIG. 5 is a diagrammatic view illustrating the positions of flow control orifices in the walls of the piston cylinders in the device.

Like sets of flow orifices are formed through the walls of the two pressure cylinders 26 and 28, as illustrated most clearly in FIG. 5, which illustrates the walls of the two cylinders, broken apart at a position near the tops of the cylinders and unrolled. Cylinder 26 includes an inner end wall 32 and outer end wall 34. Wall 32 is joined to plate 30 and wall 34 is joined to one of the heads 24. Cylinder 26 includes an inner end wall 36 and an outer end wall 38. Wall 36 is joined to plate 30 and wall 38 is joined to the adjacent head 24. A set of flow orifices 40 are formed through the wall of cylinder 26 and a set 40 of flow orifices 42 are formed through the walls of cylinder 28.

As illustrated in FIG. 5, the sets 40 and 42 are mirror images of each other with each set including a member of return orifices 46 arranged in a circle extending around the cylinder located a short distance inwardly from a respective outer end wall 34, 38, and a number of dampening orifices 48 arranged in a pattern along the length of the cylinder adjacent the respective adjacent outer end wall 32, 34.

A piston 50 is fitted in each cylinder 26, 28 and is attached to a piston rod 52 which extends outwardly from housing 20 through a rod bore 54 formed through adjacent head 24. Outer cylindrical body 24 extends around the inner cylinders 26 and 28 and plate 30 to define an outer annular chamber 56 extending along the length of the housing between heads 24 and overlying both pressure cylinders. The end heads 24, pressure cylinders 26 and 28 and plate 30 define two cylindrical pressure chambers 58 and 60. Charging plugs 62 are provided in end heads 24 and communicate with chamber 56 to permit charging of hydraulic fluid and pressurized nitrogen gas from either end of the housing 20.

Cushioning device 10 is fitted in the underframe 12 as illustrated in FIG. 1 with housing 20 held in place on the sliding sill 16 between sill walls 18 and two pairs of stops 64. The housing is supported on plates secured to the bottom of the sliding sill. Rods 52 normally extend outwardly from the housing with the ends of the rods engaging fixed sill stops 66. These stops are attached to sill 14 by plate assemblies 68 located under the sliding sill and extending laterally to engage the bottom flanges of the fixed sill.

Figure 3:
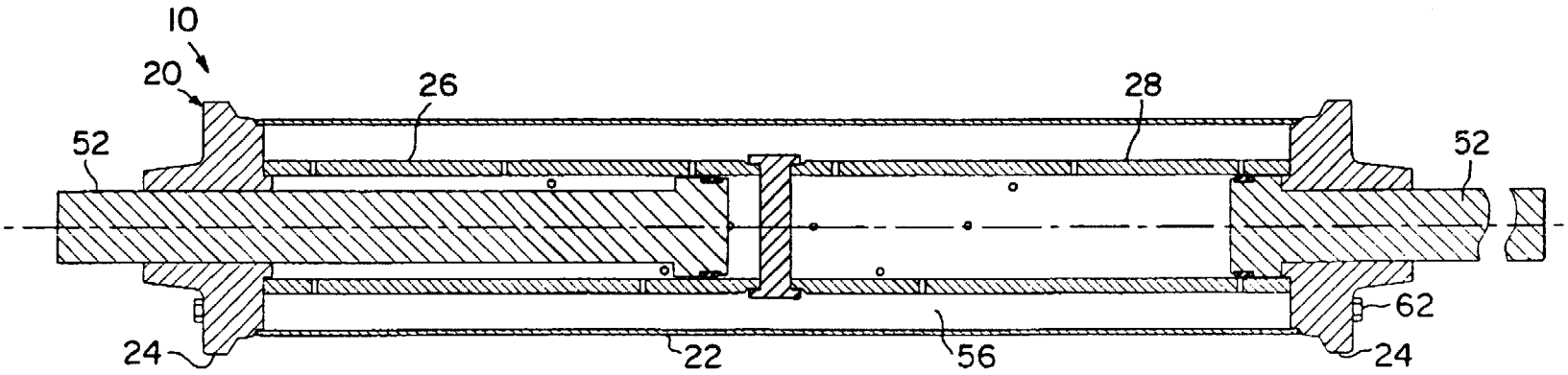

A buff or draft loading of one of the couplers attached to the end of the sliding sill will move the sill longitudinally relative to the fixed sill and move the housing toward one of the piston rods 52 held on a fixed stop 66 so that the attached piston is moved away from an end head and into a pressure cylinder 26, 28. Movement of the piston from the extended position into the pressure cylinder displaces hydraulic fluid ahead of the piston out of a chamber 58, 60 through orifices 48. Hydraulic fluid freely returns behind the piston through orifices 46. As the piston moves inwardly along the pressure cylinder, it passes orifices 48 thereby reducing the cross-sectional area through which hydraulic fluid can flow out of the chamber to provide a constant damping force. The damping orifices 48 are sized and located in the two cylinders as illustrated to provide progressive and efficient damping of the loading. Each piston moves along its own cylinder and past its own set of dedicated orifices during the dampening stroke. FIG. 3 illustrates the position of device 10 with one piston and rod fully collapsed into high pressure inner cylinder 26.

Hydraulic fluid displaced from the interior of a chamber 58, 60 during collapse of one of the pistons and rods is flowed outwardly of the cylinder into the outer chamber 56 and through orifices 46 back behind the piston. During initial collapse, hydraulic fluid flows through orifice 44 and behind the piston. The increase of pressure in chamber 56 may flow some of the pressurized fluid into the inner chamber 58, 60 of the other pressure cylinder.

After the cylinder and rod have been fully collapsed differential pressure exerted on opposite sides of the piston 50 biases the piston and rod outwardly of the housing to the extended position. During return of the piston rod to the extended position hydraulic fluid is flowed out through orifices in the pressure cylinder located behind the piston and is flowed in through orifices in the pressure cylinder ahead of the piston.

While we have illustrated and described a preferred embodiment of my invention, it is understood that this is capable of modification, and we therefore do not wish to be limited to the precise details set forth, but desire to avail ourselves of such changes and alterations as fall within the purview of the following claims.

What I claim as my invention is:

1. A double acting cushioning unit for a rail car comprising a housing having a pair of spaced apart end heads, a plate located between the end heads, a pair of pressure cylinders each joined at one end to one of said end heads and at the other end to the plate, an outer body overlying said pressure cylinders, a set of flow orifices formed in each said pressure cylinder, each said set of flow orifices communicating the interior of one of said pressure cylinders with a space outside said pressure cylinder, and a rod bore formed through each said end head communicating with the interior of one of said pressure cylinders; and a piston rod extending through each said rod bore and having an end located in one of said pressure cylinders, and a piston on said end of said piston rod, said pistons engaging said pressure cylinders.

2. A device as in claim 1 wherein the sets of flow orifices are mirror images of each other.

3. A device as in claim 1 wherein each said set of orifices includes a plurality of damping orifices and a return orifice.

4. A device as in claim 3 wherein each said set of flow orifices includes a plurality of return orifices arranged around the circumference of one of said pressure cylinders and adjacent one of the end heads.

5. A device as in claim 3 wherein each said set of flow orifices includes a plurality of dampening orifices spaced along the length of one of said pressure cylinders.

6. A device as in claim 5 wherein each said set of flow orifices includes a plurality of return orifices arranged around the circumference of one of said pressure cylinders and adjacent one of said end heads.

7. A device as in claim 6 wherein the sets of flow orifices are mirror images of each other.

8. A device as in claim 1 wherein said outer body comprises bodies comprise a single member and including an outer generally annular chamber located between the pressure cylinders and said member and extending to either side of the plate.

9. A device as in claim 8 including a charging plug in one of said end heads, said plug communicating with the outer chamber.

10. A device as in claim 8 wherein said plate is spaced from the outer body.

11. A device as in claim 1 wherein the outer body surrounds the cylinders and is joined to the end heads.

12. A double acting center-of-car cushioning device for mounting in a pocket in a sliding sill of a rail car, said device including a generally cylindrical housing having a pair of end heads, a pair of pressure cylinders each connected to one said end head and extending toward the other said cylinder, a center plate joined to the ends of the pressure cylinders away from the end heads, said end heads, the pressure cylinders and the plate defining a pair of spaced pressure chambers, rod bores extending through said end heads and opening into said pressure chambers, and an outer body surrounding the pressure cylinders and the plate and joined to the end heads, said body, said end heads, said pressure cylinders and said plate defining an outer annular chamber, a pair of piston rods, each said piston rod extending through one of said rod bores with an end located in one of said pressure chambers, a piston on the end of each said piston rod and engaging an interior surface of one of said pressure cylinders, and a set of flow orifices formed in each said pressure cylinder, each said set of orifices including damping orifices spaced along one of said pressure cylinders adjacent the plate and at least one return orifice located adjacent one of said end heads.

13. A device as in claim 12 wherein each said set of flow orifices includes a plurality of return orifices spaced around one of said pressure cylinders.

14. A device as in claim 13 wherein each set of orifices includes a plurality of return orifices spaced around each pressure cylinder.

* * * * *

UNITED STATES PATENT AND TRADEMARK OFFICE

CERTIFICATE OF CORRECTION

PATENT NO. : 5,746,335

DATED : May 5, 1998

INVENTOR(S) : Steve A. Brough, et al.

Figure 4:
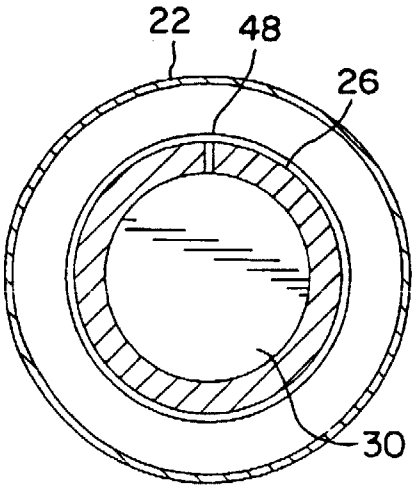
FIG. 4 the sectional view taking along line 4—4 FIG. 2.
Figure 2:
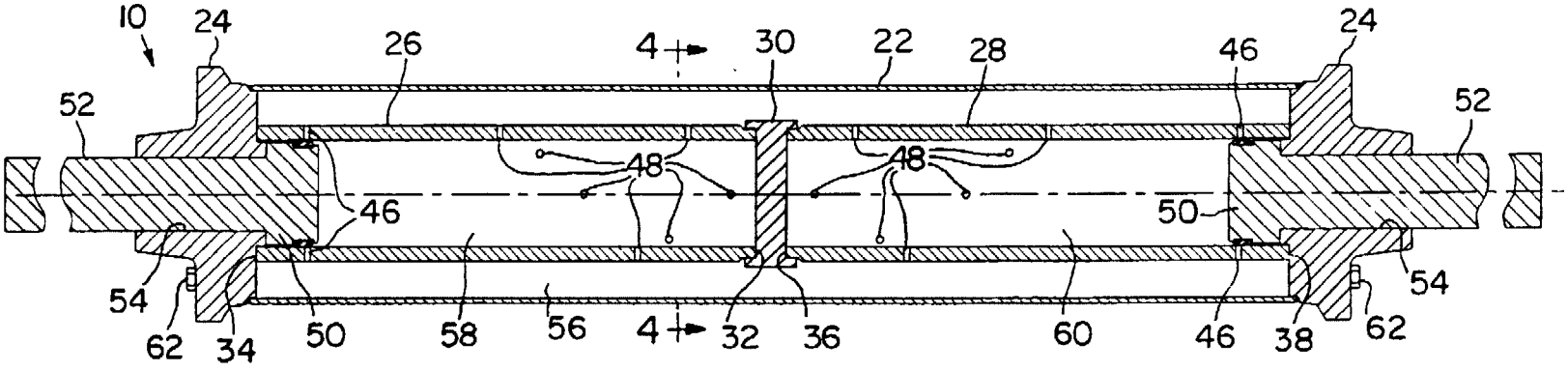
FIGS. 2 and 3 are vertical sectional views showing a cushioning device in different positions.

It is certified that error appears in the above-identified patent and that said Letters Patent is hereby corrected as shown below:

Column 2, line 10, following "FIG. 4", delete "the" and substitute --is a-- therefor.
Column 2, line 46, following "heads 24. Cylinder", replace "26" with --28--.
Column 2, line 63, following "Outer cylindrical body" replace "24" with --22--.

In the Claims:

Claim 8, line 2, delete "bodies comprise".

Claim 13, delete lines 1-3 in their entirety, and substitute --A device as in claim 12 wherein the dampening orifices of said sets are mirror images of each other.--.

Claim 14, delete lines 1-3 in their entirety, and substitute --A device as in claim 13 wherein each said set of flow orifices includes a plurality of return orifices spaced around one of said pressure cylinders.--.

Signed and Sealed this

Fifteenth Day of September, 1998

*Attest:*

Bruce Lehman

BRUCE LEHMAN

*Attesting Officer*

*Commissioner of Patents and Trademarks*